US007263836B2

(12) United States Patent
Gunawardana et al.

(10) Patent No.: US 7,263,836 B2
(45) Date of Patent: Sep. 4, 2007

(54) VORTEX TUBE COOLING SYSTEM

(75) Inventors: Ruvinda Gunawardana, Sugar Land, TX (US); G. Alexis Arzoumanidis, Boston, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 401 days.

(21) Appl. No.: 10/709,615

(22) Filed: May 18, 2004

(65) Prior Publication Data

US 2005/0257533 A1 Nov. 24, 2005

(51) Int. Cl.
*F25B 9/02* (2006.01)

(52) U.S. Cl. ..... 62/5

(58) Field of Classification Search ..... 62/5
See application file for complete search history.

(56) References Cited

U.S. PATENT DOCUMENTS

| | | | | |
|---|---|---|---|---|
| 1,952,281 | A | 3/1934 | Ranque | |
| 2,861,780 | A | 11/1958 | Butler | |
| 3,208,229 | A | 9/1965 | Fulton | |
| 3,654,768 | A * | 4/1972 | Inglis et al. | 62/5 |
| 4,287,957 | A | 9/1981 | Evans | |
| 4,333,017 | A * | 6/1982 | O'Connell | 290/2 |
| 4,339,926 | A | 7/1982 | Moretti et al. | |
| 4,400,858 | A | 8/1983 | Goiffon et al. | |
| 4,513,352 | A | 4/1985 | Bennett et al. | |
| 4,722,026 | A | 1/1988 | Bennett et al. | |
| 5,547,028 | A | 8/1996 | Owens et al. | |
| 5,720,342 | A | 2/1998 | Owens et al. | |
| 5,730,217 | A | 3/1998 | Owens et al. | |
| 5,931,000 | A | 8/1999 | Turner et al. | |
| 6,341,498 | B1 | 1/2002 | DiFoggio | |
| 6,401,463 | B1 | 6/2002 | Dukhan et al. | |
| 6,424,533 | B1 | 7/2002 | Chu et al. | |
| 6,672,093 | B2 | 1/2004 | DiFoggio | |
| 2005/0034917 | A1 | 2/2005 | Mathiszik et al. | |

* cited by examiner

*Primary Examiner*—Frantz Jules
*Assistant Examiner*—John Pettitt
(74) *Attorney, Agent, or Firm*—Kevin P. McEnaney; Brigitte L. Echols; Dale V. Gandier

(57) ABSTRACT

Systems and methods for cooling a component within a housing adapted for subsurface disposal using a vortex tube. The housing contains a first pressure chamber; a vortex tube coupled to the first pressure chamber; a cooling chamber coupled to the vortex tube; and a second pressure chamber-coupled to the cooling chamber; wherein the pressure chambers are adapted to stimulate a cool fluid flow from the vortex tube into the cooling chamber. A cooling method entails disposing the component to be cooled within the cooling chamber and adapting the system pressure chambers to stimulate a cool fluid flow from a vortex tube into the cooling chamber.

36 Claims, 6 Drawing Sheets

VORTEX TUBE COOLING SYSTEM

BACKGROUND OF INVENTION

1. Field of the Invention

The present invention relates generally to cooling systems and techniques using vortex tubes.

2. Background Art

The use of vortex tubes (also know as the "Ranque Tube", "Hilsch Tube", "Ranque-Hilsch Tube", and "Maxwell's Demon") to implement systems for emitting colder and hotter gas streams is well known (See U.S. Pat. Nos. 1,952,281, 3,208,229, 4,339,926). A vortex tube offers a simple method of cooling using compressed air. Compressed air at high pressure is passed through a nozzle that sets the air in a vortex motion inside the vortex tube. A valve at one end of the tube allows the warmed air from this first vortex to escape. Some of the air that does not escape heads back up the tube as a second vortex inside the low pressure inner area of the larger first vortex. The inner vortex loses heat and exits through the other end of the tube as a cold air stream. Further description of vortex tubes can be found on the World Wide Web (See http://www.exair.com/vortextube/vt_page.htm). Thus the vortex tube takes compressed air as an input and outputs two streams of air, one heated and the other cooled.

In hydrocarbon exploration operations, there is a need to use electronic devices at temperatures much higher than their rated operational temperature range. With oil wells being drilled deeper, the operating temperatures for these devices keeps increasing. Besides self-generated heat, conventional electronics used in the computer and communications industry generally do not have a need to operate devices at high temperatures. For this reason, most commercial electronic devices are rated only up to 85° C. (commercial rating).

Modern tools or instruments designed for subsurface logging operations are highly sophisticated and use electronics extensively. In order to use devices that are commercially rated in a subsurface or downhole environment, it is highly desirable to have a cooling system capable of maintaining the electronics within their operational range while disposed downhole. Conventional logging techniques include instruments for "wireline" logging, logging-while-drilling (LWD) or measurement-while-drilling (MWD), logging-while-tripping (LWT), coiled tubing, and reservoir monitoring applications. These logging techniques are well known in the art.

Several approaches to extending the life of electronics in hot environments have been proposed in the past. U.S. Pat. No. 4,400,858 describes retainer clips that serve as heat sinks to conduct heat from the electronics to the tool housing to minimize temperature rise in the devices. U.S. Pat. No. 4,722,026 describes a method for reducing the temperature rise of critical devices by placing them in a dewar. U.S. Pat. No. 4,513,352 describes a dewar combined with heat conducting pipes to reduce the heating of electronics in a geothermal borehole. U.S. Pat. No. 4,375,157 describes a downhole refrigerator to protect electronics in the drilling environment. U.S. Pat. No. 5,720,342 proposes the use of a thermoelectric cooler attached directly to a multi chip module to cool the module. U.S. Pat. No. 5,730,217 describes a thermoelectric cooler used to cool electronics disposed in a vacuum to reduce heat gain from the ambient environment. Other methods to cool electronics using thermoelectric coolers are proposed in U.S. Pat. Nos. 5,931,000, 5,547,028 and 6,424,533. U.S. Pat. No. 6,341,498 proposes a cooling system including a container for a liquid and a sorbent to transfer heat from the electronics to the wellbore. U.S. Pat. No. 6,401,463 describes a cooling and heating system using a vortex tube to cool an equipment enclosure.

Vortex tubes have also been implemented in downhole instruments for cooling purposes. U.S. Pat. No. 2,861,780 describes a system using vortex tubes to cool the cutters of drill bits. U.S. Pat. No. 4,287,957 describes another system using a vortex tube to cool tool components. A drawback of the system proposed in the '957 patent is the need for a pressurized gas source at the surface for continuous gas feed, making the system impractical for many subsurface operations.

There remains a need for improved cooling techniques to maintain components at a temperature below the ambient temperatures experienced in hot environments, particularly electronics housed in instruments adapted for subsurface disposal, where rapid temperature variations are encountered.

SUMMARY OF INVENTION

The invention provides a vortex tube cooling system. The system including a housing adapted for subsurface disposal, the housing containing a first pressure chamber; a vortex tube coupled to the first pressure chamber; a cooling chamber coupled to the vortex tube; and a second pressure chambercoupled to the cooling chamber; wherein the pressure chambers are adapted to stimulate a cool fluid flow from the vortex tube into the cooling chamber.

The invention provides a vortex tube cooling system. The system includes a housing adapted for subsurface disposal, the housing containing: a first pressure chamber adapted to sustain high fluid pressure; a vortex tube coupled to the first pressure chamber; a cooling chamber coupled to the vortex tube; a second pressure chamber coupled to the cooling chamber and adapted to sustain lower fluid pressure in relation to the first pressure chamber; at least one valve linked between the first pressure chamber and the cooling chamber to regulate fluid flow to stimulate a cool fluid flow from the vortex tube into the cooling chamber.

The invention provides a method for cooling a component within a housing adapted for subsurface disposal. The method includes equipping the housing with: a first pressure chamber; a vortex tube coupled to the first pressure chamber; a cooling chamber coupled to the vortex tube; a second pressure chambercoupled to the cooling chamber; disposing the component to be cooled within the cooling chamber; and adapting the pressure chambers to stimulate a cool fluid flow from the vortex tube into the cooling chamber.

BRIEF DESCRIPTION OF DRAWINGS

Other aspects and advantages of the invention will be apparent from the following description and the appended claims.

DETAILED DESCRIPTION

The disclosed cooling systems are based on a vortex tube to provide cooling. These cooling techniques are not limited to any particular field, they apply to any application where cooling is desired.

Figure 1:
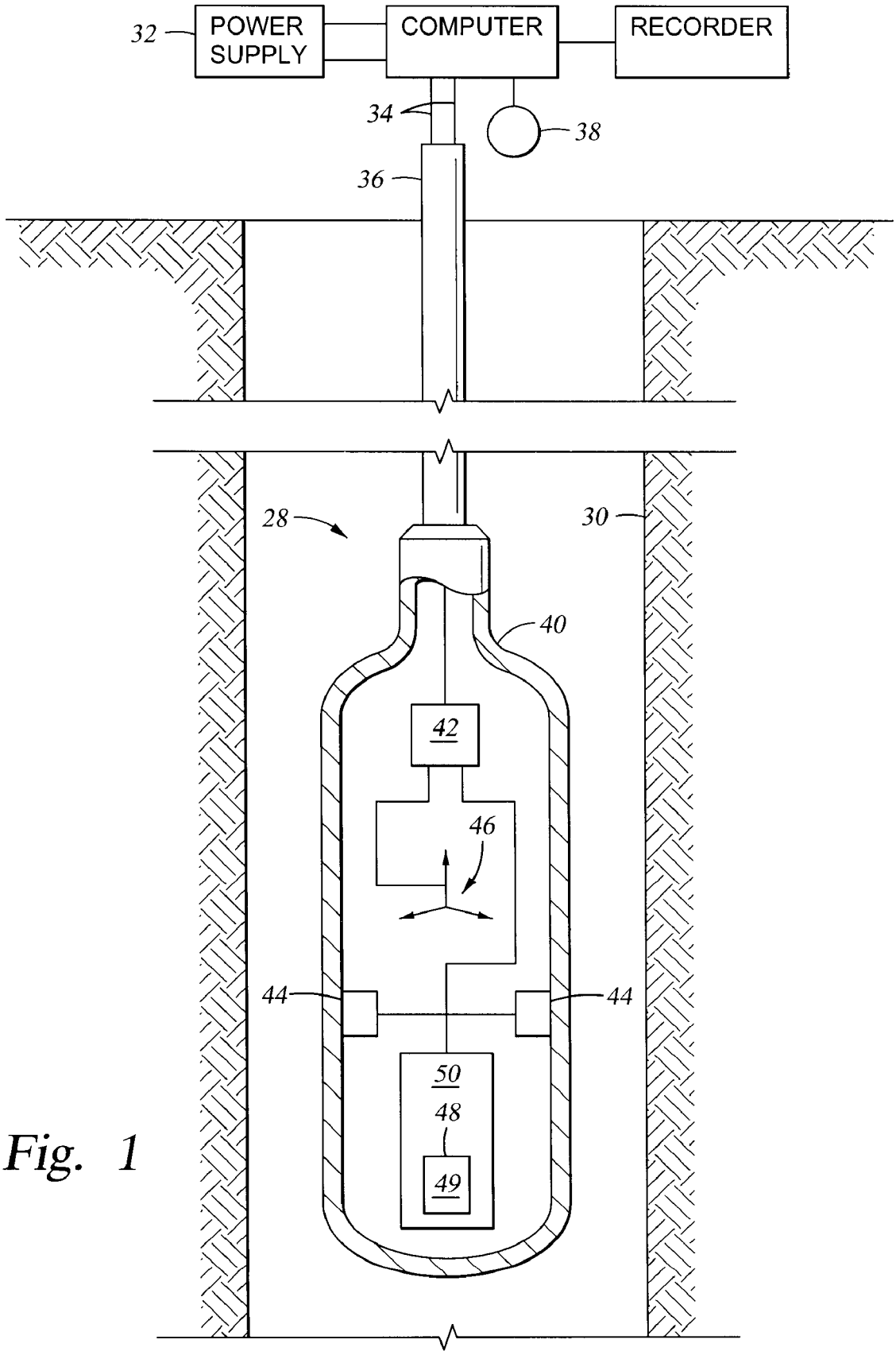
FIG. 1 shows a downhole instrument disposed in a borehole and equipped with a vortex tube cooling system in accord with the invention.

FIG. 1 shows an instrument designed for subsurface logging operations including a vortex tube cooling system 50 of the invention. The downhole tool 28 is disposed in a borehole 30 that penetrates an earth formation. The cooling system 50 includes a cooling chamber 48 adapted to house the component(s) 49 (e.g. electronics) to be cooled. The tool 28 also includes a multi-axial electromagnetic antenna 46, a conventional source/sensor 44 array for subsurface measurements (e.g., nuclear, acoustic, gravity), and an circuit junction 42. The tool housing 40 may be any type of conventional shell, such as a metallic, non-metallic, or composite sleeve as known in the art. The tool 28 is shown supported in the borehole 30 by a multi-wire cable 36 in the case of a wireline system or a drill string 36 in the case of a while-drilling system.

With a wireline tool, the tool 28 is raised and lowered in the borehole 30 by a winch 38, which is controlled by the surface equipment 32. Logging cable or drill string 36 includes conductors 34 that connect the tool's electronics with the surface equipment 32 for signal and control communication. Alternatively, these signals may be processed or recorded in the tool 28 and the processed data transmitted to the surface equipment 32. FIG. 1 exemplifies a typical logging tool configuration implemented with a vortex tube system of the invention. It will be appreciated by those skilled in the art that other types of downhole instruments and systems may be used to implement the invention.

For clarity of illustration, the vortex tube cooling systems 50 of the invention are shown schematically. Conventional components, connectors, valves and mounting hardware may be used to implement the cooling systems 50 as known in the art. It will also be appreciated by those skilled in the art that while the component couplings and operational designs of the cooling systems of the invention are specifically disclosed, the actual physical layout of the systems may vary depending on the space constraints of the particular implementation.

Figure 2:
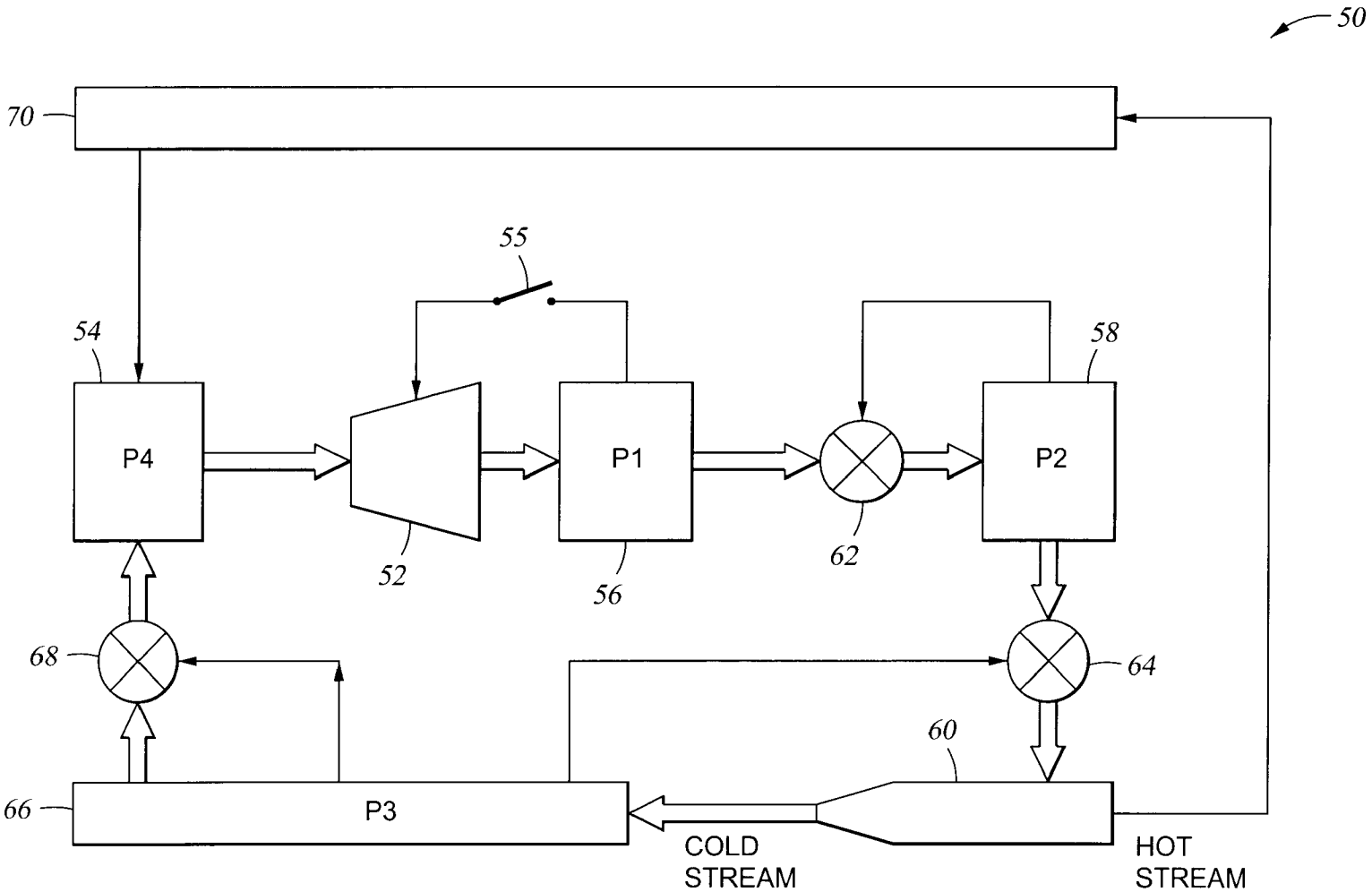
FIG. 2 is a schematic diagram of an active vortex tube cooling system including a compressor in accord with the invention.

FIG. 2 shows a cooling system 50 of the invention. The system includes a compressor 52 to pump a fluid from a low-pressure chamber 54 to a high-pressure chamber 56 to maintain these chambers within a desired operational range. The Cooling systems 50 of the invention may be implemented using compressible fluids (e.g. air or gaseous mixtures), and in some cases the use of incompressible fluids (e.g. liquids) may also be possible. An optional high-pressure cutoff switch 55 may be added to the high-pressure chamber 56 as an added safety feature. An intermediate chamber 58 is also disposed between the high-pressure chamber 56 (where the pressure is P1) and the vortex tube 60. In this embodiment, the intermediate chamber 58 is kept at pressure P2, which may be the optimal desired intake pressure for the vortex tube 60. The pressure P2 in the intermediate chamber 58 is regulated via a control valve 62. The fluid flow into the vortex tube 60 from the intermediate high-pressure chamber 58 is controlled via a control valve 64 to maintain the component(s) 49 within the cooling chamber 66 at the desired temperature. The valve 64 can be opened to allow fluid flow and cooling when the cooling chamber 66 temperature rises above a minimum value of a desired operating temperature for the cooling chamber 66 component(s) 49. The valve 64 can be closed and cooling stopped if the temperature falls below the minimum. This type of control may require some hysteresis to prevent chattering.

Pressure in the cooling chamber 66 is maintained at a desired optimal pressure P3 for the vortex tube 60 outlet via a control valve 68. When the pressure in the cooling chamber 66 rises above P3, control valve 68 is opened to allow fluid flow into the low-pressure chamber 54 until the pressure falls back to P3. The compressor 52 maintains the low-pressure chamber 54 at pressure P4, which is less than P3. In some embodiments, the low-pressure chamber 54 may be of sufficient size such that in order to have the pressure in the low-pressure chamber 54 approach P3, the pressure in the high-pressure chamber 56 must fall far below P1 to trigger the compressor 52. The hot fluid stream out of the vortex tube 60 is directed to a heat exchanger 70 where the heat gained in the vortex tube is rejected to the ambient and the fluid stream is cooled down to ambient temperature before it is routed into the low-pressure chamber 54.

As known in the art, downhole tools used for while-drilling applications are typically powered by turbines that are operated via the borehole fluid ("mud") flowing through the tool. These tools generally have a battery power backup to keep the tools operational when mudflow is stopped periodically for various reasons. The vortex tube cooling system 50 described in FIG. 2 may be implemented in a while-drilling downhole tool 28. In such an embodiment, the compressor 52 used to generate high pressure for the vortex tube 60 can be operated either directly via the mud turbine or by having it powered electrically as known in the art (not shown).

An advantage of using a vortex tube for downhole while-drilling applications is that it enables holdover capability. That is, when the mud pumps are switched off and the compressor 52 stops, for a limited period of time the vortex tube 60 can continue to cool the cooling chamber 66 due to the pressure built up in the high-pressure chamber 56. This can be very useful as the tool 28 generally sees the highest temperatures when the mud pumps are switched off. The holdover capabilities can be increased by increasing the size of the system chambers (e.g. the high 56 and low-pressure 54 chambers).

Figure 3:
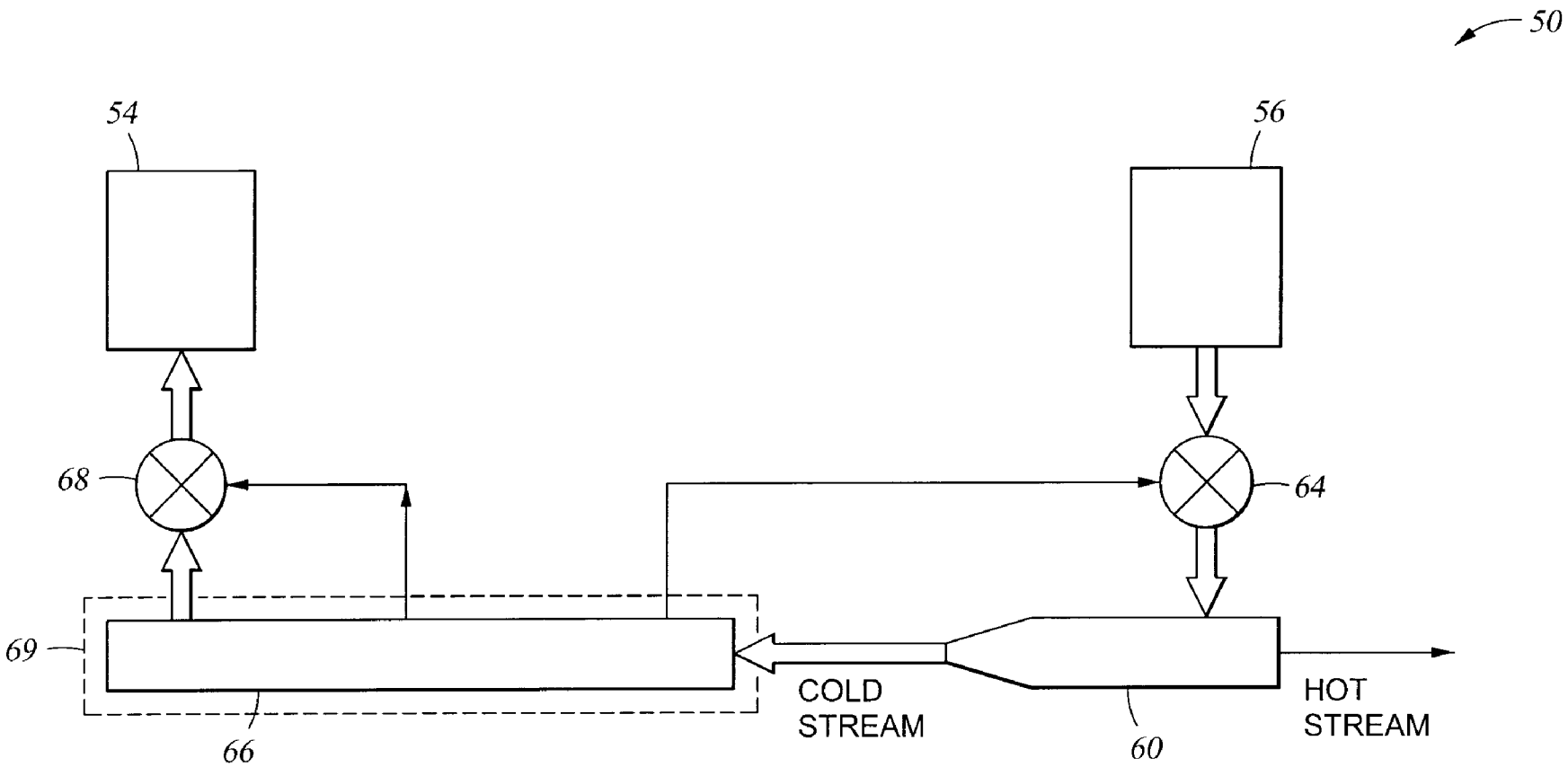
FIG. 3 is a schematic diagram of a passive vortex tube cooling system in accord with the invention.
Figure 4:
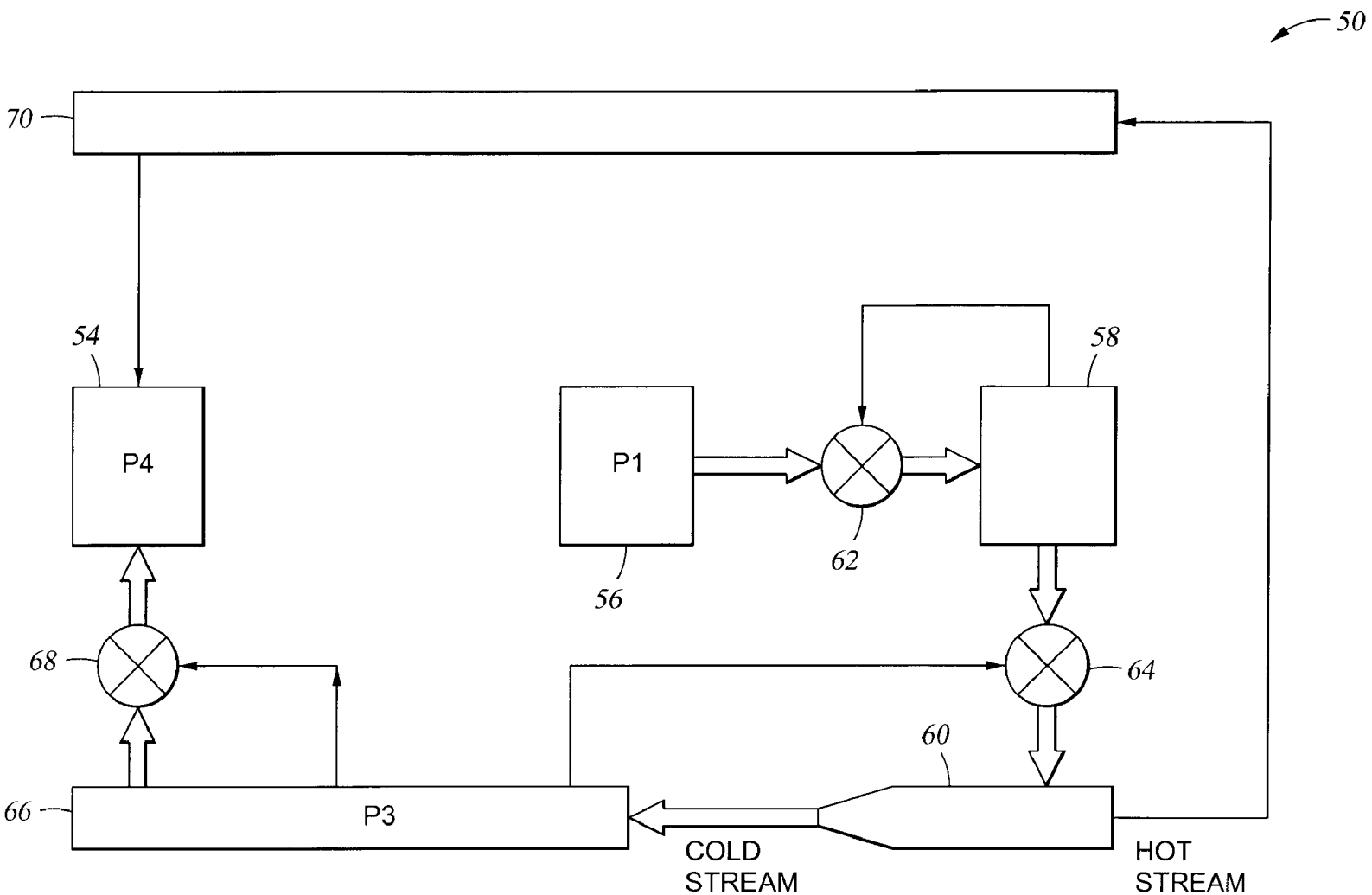
FIG. 4 is a schematic diagram of another passive vortex tube cooling system in accord with the invention.

In applications where exposure to high temperatures is only for a limited period of time, cooling is similarly required for a brief period of time. A passive vortex tube cooling system is suitable for such applications. FIG. 3 shows a passive cooling system 50 embodiment of the invention. In this embodiment, the compressor 52 (see FIG. 2) does not exist. The low-pressure chamber 54 is evacuated and the high-pressure 56 chamber is prepressurized. During operation, the vortex tube 60 provides cooling until the pressure in the low-pressure chamber 54 becomes too high for adequate fluid flow through the vortex tube 60. The control valves 64, 68 serve the same purpose as described with respect to FIG. 2. The hot fluid stream from the vortex tube 60 is routed to the ambient environment. FIG. 4 shows another passive cooling system 50 embodiment of the invention. This embodiment is similar to that of FIG. 3, with the addition of a heat exchanger 70 and an intermediate high-pressure chamber 58 as described with respect to FIG. 2. The control valves of these embodiments serve the same purpose.

The passive vortex tube cooling systems 50 described in FIG. 3 and FIG. 4 are suitable for downhole wireline tool applications. In such applications, the high-pressure chamber 56 can be pressurized at the surface prior to subsurface disposal. While it may be advantageous to use a passive cooling system for wireline applications in instances where tool space is premium, other wireline embodiments can be implemented with a compressor (52 in FIG. 2) powered through the tool 28 power supply. As described above, wireline tools are powered through a multi-wire cable that is attached to the tool 28 from the surface.

A limitation on the holdover capability (the period of time the vortex cooler can continue to cool with the compressor off) of the cooling systems of the invention is the pressure buildup in the low-pressure chamber 54. Once the pressure in the low-pressure chamber 54 rises above what is acceptable for the cooling chamber 66 or the maximum outlet pressure that the vortex tube 60 can operate at efficiently, cooling is effectively stopped. The high-pressure side of the systems faces no such limitation. The pressure in the high-pressure chamber 56 can be built up very high, allowing for a compressed fluid supply for an extended period of time.

Figure 5:
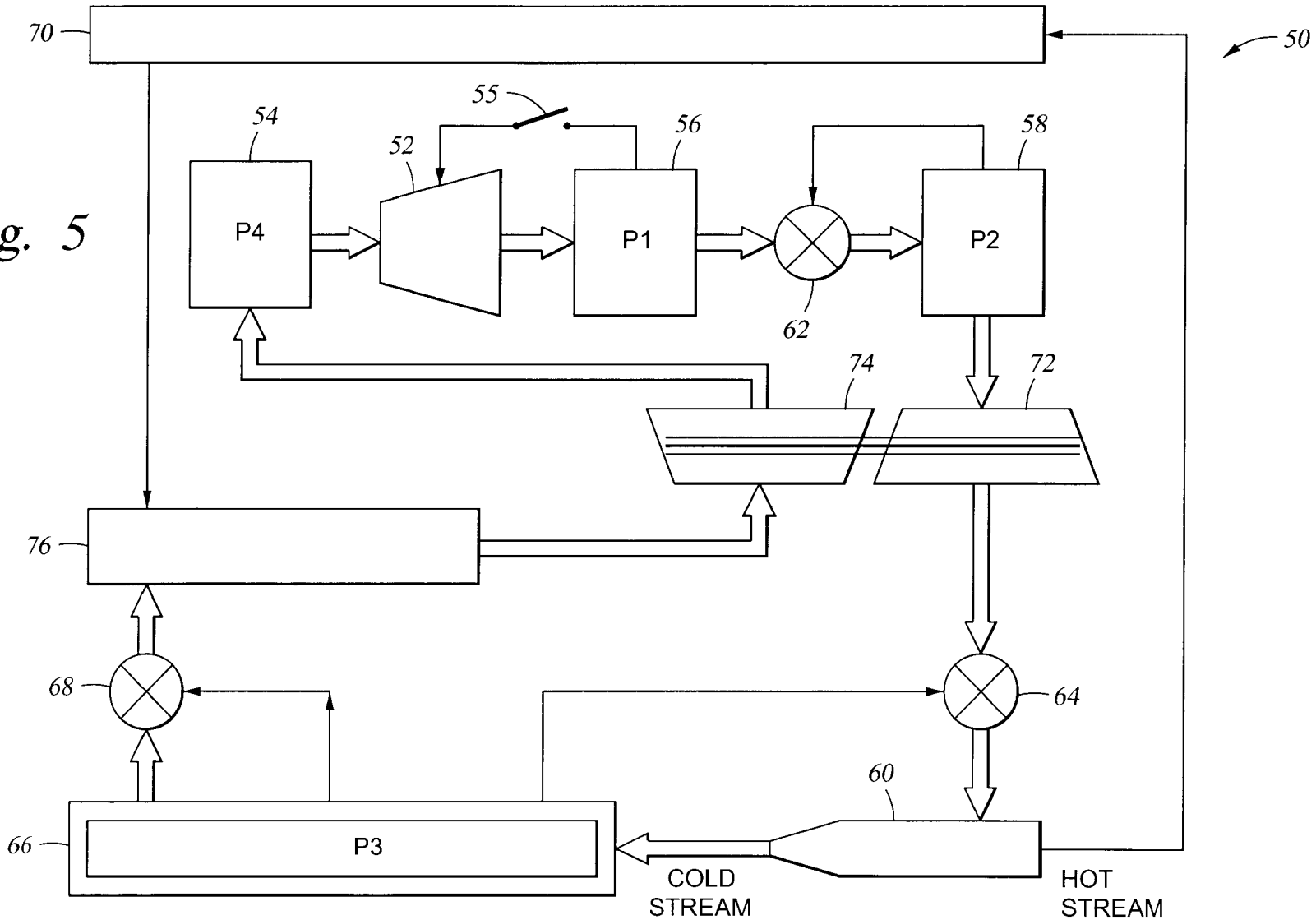
FIG. 5 is a schematic diagram of an active vortex tube cooling system providing an extended operational capability in accord with the invention.

FIG. 5 shows an embodiment of the invention that provides a way to extend the holdover capability of the cooling system 50. The high-pressure supply of the high-pressure chamber 56 is used to operate essentially a small turbine 72, which turns a small secondary compressor 74 to pump fluid from an intermediate low-pressure chamber 76 to the low-pressure chamber 54. In this embodiment, the additional intermediate low-pressure chamber 76 enables the cooling chamber 66 and the heat exchanger 70 to be maintained at an optimal pressure for an extended period of time. The small turbine 72 compressor 74 pair can be a pair of fans on the same shaft with one set of blades causing the fan to turn through the fluid flow into the vortex tube 60 while the other set of blades pump fluid out of the intermediate low pressure chamber 76 to the low pressure chamber 54. The system of FIG. 5 also includes a double-walled cooling chamber 66. By passing the cool fluid stream from the vortex tube 60 through the annular space between the chamber 66 walls, the chamber's contents are thereby shielded from pressure. Double-walled chambers may be used for any implementation of the invention.

The same holdover extension can be added to the passive cooling systems of the invention to increase the amount of time the passive systems can operate. Since the pressure in the low-pressure chamber 54 will be higher than that in the intermediate low-pressure chamber 76 when operating passively, a one-way valve (not shown) between these two chambers may be used to allow fluid flow only from the intermediate low-pressure chamber 76 to the low-pressure chamber 54.

When implemented in downhole tools for subsurface disposal, the cooling systems of the invention provide several benefits. Minimal moving parts in the cooling system (the vortex tube itself has no moving parts) provide a major advantage in qualifying the instruments for shock and vibration. The use of air for the working fluid minimizes environmental and other concerns with using the systems in the downhole environment. The systems also have the capability to operate passively for a period of time, which is particularly useful in applications where power is not supplied or interrupted.

Figure 6:
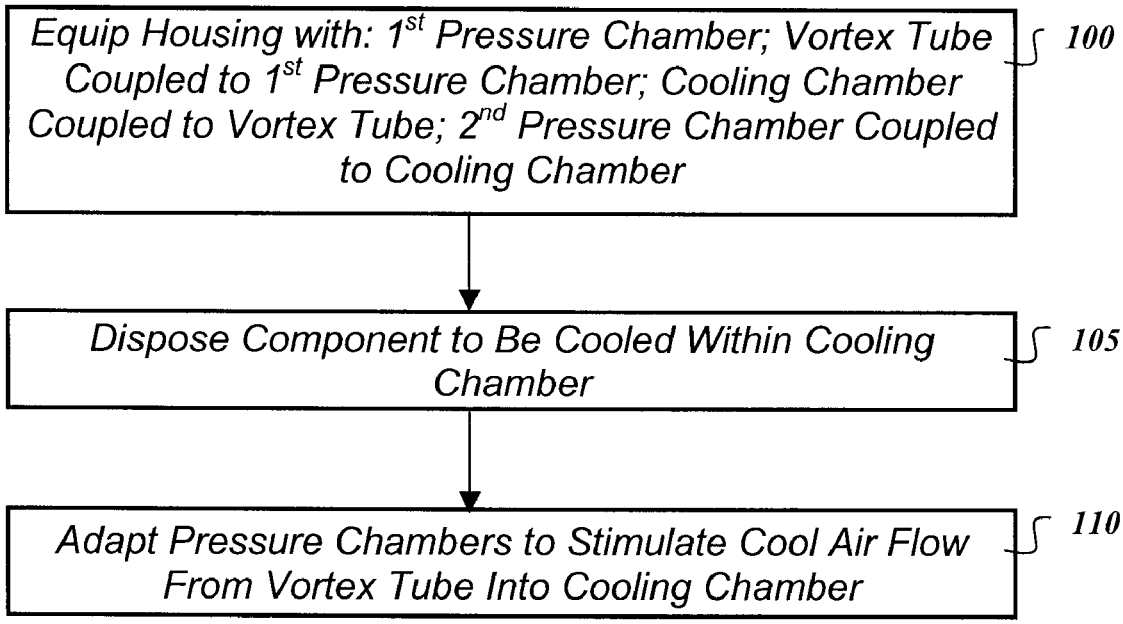
FIG. 6 illustrates a flow chart of a process for cooling a component within a housing adapted for subsurface disposal in accord with the invention.

FIG. 6 shows a flow chart illustrating a process for cooling a component within a housing adapted for subsurface disposal according to the invention. At step 100, the process begins by equipping the housing with: a first pressure chamber; a vortex tube coupled to the first pressure chamber; a cooling chamber coupled to the vortex tube; and a second pressure chamber coupled to the cooling chamber. The component 49 to be cooled is then deposed within the cooling chamber (at step 105). Then the pressure chambers are adapted to stimulate a cool fluid flow from the vortex tube into the cooling chamber as described herein (at step 110). For example, in passive systems the pressure chambers are adapted by pressurizing the high-pressure chamber and evacuating the low-pressure chamber at the surface prior to subsurface disposal.

While the invention has been described with respect to a limited number of embodiments, those skilled in the art will appreciate that other embodiments can be devised which do not depart from the scope of the invention. For example, the pressure chambers of the cooling systems may be insulated using conventional insulating materials or Dewar flasks if desired (shown at 69 in FIG. 3). It will also be appreciated that with some modification the cooling systems of the invention may be used as heating systems or combined cooling-heating systems by appropriate routing of the fluid streams from the vortex tube.

What is claimed is:

1. A vortex tube cooling system, comprising:

a housing adapted for subsurface disposal, the housing containing:

a first gas storage chamber;

a vortex tube coupled to the first gas storage chamber;

a cooling chamber coupled to the vortex tube; and a second gas storage chamber coupled to the cooling chamber;

wherein the first and second gas storage chambers are adapted to stimulate a cool fluid flow from the vortex tube into the cooling chamber;

wherein the cool fluid flow is retained within the housing.

2. The system of claim 1, wherein the first gas storage chamber is adapted for pressurization and the second gas storage chamber is adapted for evacuation.

3. The system of claim 1, the housing further comprising a third gas storage chamber coupled between the first gas storage chamber and the vortex tube, the third chamber adapted to sustain a predetermined fluid pressure for input to the vortex tube.

4. The system of claim 1, the housing further comprising a heat exchanger coupled between the second gas storage chamber and the vortex tube, the heat exchanger adapted to receive hot fluid flow from the vortex tube.

5. The system of claim 1, the housing further comprising a compressor adapted to pump a fluid from the second gas storage chamber into the first gas storage chamber.

6. The system of claim 5, the housing further comprising:

a third gas storage chamber coupled between the cooling chamber and the second gas storage chamber; and a second compressor adapted to pump a fluid from the third gas storage chamber into the second gas storage chamber.

7. The system of claim 1, wherein the cooling chamber is double walled and adapted to allow fluid flow from the vortex tube through a space between the walls of the cooling chamber.

8. The system of claim 1, wherein the housing is adapted for disposal within a borehole traversing a subsurface formation while drilling the borehole.

9. The system of claim 1, wherein the housing is adapted for disposal within a borehole traversing a subsurface formation via a wireline cable.

10. The system of claim 1, further comprising a plurality of valves linked between the first gas storage chamber, the second gas storage chamber, and the cooling chamber to regulate fluid flow through the chambers.

11. The system of claim 1, wherein the cooling chamber is adapted to house an electronic component.

12. The system of claim 1, wherein the exterior of at least one of the first gas storage chamber, second gas storage chamber, and the cooling chamber is covered by an insulating material.

13. The system of claim 1, wherein at least one of the first gas storage chamber, second gas storage chamber, and the cooling chamber is disposed within a Dewar flask.

14. A method for cooling a component within a housing adapted for subsurface disposal, comprising:

a) equipping the housing with:
- a first gas storage chamber;
- a vortex tube coupled to the first gas storage chamber;
- a cooling chamber coupled to the vortex tube;
- a second gas storage chamber coupled to the cooling chamber;

b) disposing the component to be cooled within the cooling chamber; and c) adapting the gas storage chambers to stimulate a tool fluid flow from the vortex tube into the cooling chamber;

d) retaining the cool fluid flow within the housing.

15. The method of claim 14, wherein step (c) comprises pressurizing the first gas storage chamber and evacuating the second gas storage chamber.

16. The method of claim 14, wherein step (c) comprises pumping a fluid from the second gas storage chamber into the first gas storage chamber.

17. The method of claim 14, further comprising equipping the housing with a heat exchanger coupled to the vortex tube to receive hot fluid flow from the vortex tube.

18. The method of claim 14, further comprising equipping the housing with a third gas storage chamber coupled between the cooling chamber and the second gas storage chamber, and pumping a fluid from the third gas storage chamber into the second gas storage chamber.

19. The method of claim 14, wherein the cooling chamber is double walled and adapted to allow fluid flow from the vortex tube through a space between the walls of the cooling chamber.

20. The method of claim 14, further comprising disposing the housing within a borehole traversing a subsurface formation white drilling the borehole.

21. The method of claim 14, further comprising disposing the housing within a borehole traversing a subsurface formation via a wireline cable.

22. The method of claim 14, further comprising equipping the housing with a plurality of valves linked between the first gas storage chamber, the second gas storage chamber, and the cooling chamber to regulate fluid flow through the chambers.

23. The method of claim 14, wherein the component to be cooled is an electronic component.

24. The method of claim 14, wherein at least one of the exterior of the first gas storage chamber, second gas storage chamber, and the cooling chamber is covered by an insulating material.

25. The method of claim 14, wherein a least one of the first gas storage chamber, second gas storage chamber, and the cooling chamber is disposed within a Dewar flask.

26. A vortex tube cooling system, comprising:

a housing adapted for subsurface disposal, the housing containing:

a first gas storage chamber;

a vortex tube coupled to the first gas storage chamber;

a cooling chamber coupled to the vortex tube; and a second gas storage chamber coupled to the cooling chamber, wherein the first and second gas storage chambers are adapted to stimulate a cool fluid flow from the vortex tube into the cooling chamber; and a compressor adapted to pump a fluid from the second gas storage chamber into the first gas storage chamber.

27. The system of claim 26, wherein the first gas storage chamber is adapted for pressurization and the second gas storage chamber is adapted for evacuation.

28. The system of claim 26, the housing further comprising a third gas storage chamber coupled between the first gas storage chamber and the vortex tube, the third gas storage chamber adapted to sustain a predetermined fluid pressure for input to the vortex tube.

29. The system of claim 26, the housing further comprising a heat exchanger coupled between the second gas storage chamber and the vortex tube, the heat exchanger adapted to receive hot fluid flow from the vortex tube.

30. The system of claim 26, wherein the cooling chamber is double walled and adapted to allow fluid flow from the vortex tube through a space between the walls of the cooling chamber.

31. The system of claim 26, wherein the housing is adapted for disposal within a borehole traversing a subsurface formation while drilling the borehole.

32. The system of claim 26, further comprising a plurality of valves linked between the first gas storage chamber and the cooling chamber to regulate fluid flow through the chambers.

33. The system of claim 26, wherein the cooling chamber is adapted to house an electronic component.

34. The system of claim 26, wherein the exterior of at least one of the first gas storage chamber, the second gas storage chamber, and the cooling chamber is covered by an insulating material.

35. The system of claim 26, wherein at least one of the first gas storage chamber, the second gas storage chamber, and the cooling chamber is disposed within a Dewar flask.

36. The system of claim 26, the housing further comprising:

a third gas storage chamber coupled between the cooling chamber and the second gas storage chamber; and a second compressor adapted to pump a fluid from the third gas storage chamber into the second gas storage chamber.

* * * * *